US005333639A

United States Patent [19]

Nelson

[11] Patent Number: 5,333,639

[45] Date of Patent: Aug. 2, 1994

[54] ILLUMINATED SIPHON

[76] Inventor: Monte G. Nelson, 170 E. 100 South, American Fork, Utah 84003

[21] Appl. No.: 87,375

[22] Filed: Jul. 8, 1993

Related U.S. Application Data

[63] Continuation-in-part of Ser. No. 985,923, Dec. 4, 1992, abandoned.

[51] Int. Cl.[5] ..... F04F 10/00; F21V 33/00

[52] U.S. Cl. ..... 137/150; 222/416; 362/96; 362/101

[58] Field of Search ..... 137/150, 153, 123, 124, 137/130, 141, 142, 147, 148; 362/96, 101, 253; 222/204, 416; 15/324

[56] References Cited

U.S. PATENT DOCUMENTS

| | | | |
|---|---|---|---|
| 359,502 | 3/1887 | Denison | 222/416 X |
| 1,863,203 | 6/1932 | Lewis . | |
| 2,002,107 | 5/1935 | Bourret . | |
| 2,005,251 | 6/1935 | Wood . | |
| 2,260,325 | 10/1941 | Leathers . | |
| 2,637,062 | 5/1953 | Sutton . | |
| 3,341,880 | 9/1967 | Young . | |
| 4,291,839 | 9/1981 | Brett . | |
| 4,797,206 | 1/1989 | Lynch . | |
| 5,082,028 | 1/1992 | Jean-Jacques . | |
| 5,152,026 | 10/1992 | Scarpine . | |

FOREIGN PATENT DOCUMENTS

| | | |
|---|---|---|
| 1248896 | 8/1967 | Fed. Rep. of Germany . |
| 60-185000 | 9/1985 | Japan . |
| 8102763 | 1/1983 | Netherlands . |
| 961828 | 6/1964 | United Kingdom . |

*Primary Examiner*—Martin P. Schwadron
*Assistant Examiner*—Kevin L. Lee
*Attorney, Agent, or Firm*—Richard C. Litman

[57] ABSTRACT

An illuminated siphon includes a directional light source attached adjacent the upper end of the siphon tube. The siphon includes a transmission path for the light source along the siphon inlet tube, with an illumination emission point near the inlet end of the siphon tube, and provides utility for the siphon in darkened and confined areas, such as vehicle fuel tanks. The light source and transmission path are disposed to one side of the siphon inlet tube, thus allowing a clear sight line for the operator along the opposite side of the tube. The inlet end of the siphon tube is inserted into the tank and the light source is activated, whereupon the siphon tube may be maneuvered to observe any water or other contaminates in the tank and to position the inlet end of the tube to withdraw those contaminates from the tank. The tube or pipe to which the light is attached is preferably relatively inflexible in order to provide for maneuverability of the light and inlet end from the opposite end. Additional flexible tubes or hoses may be secured to the tube to which the light is attached, and a hand or motor operated siphon pump may be secured to the remainder of the apparatus. Preferably, the various tubes and hoses are transparent to enable the user to observe any contaminates flowing within, and are also resistant to degradation due to contact with most types of fuels. Use of the siphon provides a great savings to the operator of the vehicle, especially diesel powered trucks and the like.

17 Claims, 2 Drawing Sheets

ILLUMINATED SIPHON

REFERENCE TO RELATED APPLICATION

This application is a continuation in part of U.S. utility patent application Ser. No. 07/985,923, filed on Dec. 4, 1992, now abandoned.

FIELD OF THE INVENTION

The present invention relates generally to siphons and related liquid transfer devices, and more specifically to a siphon including illumination means, providing illumination for the contents of a tank or other container to be siphoned.

BACKGROUND OF THE INVENTION

Contaminated fuel is a common problem in the trucking industry. Fuel contamination may occur in many ways, as each time fuel is transferred (e.g., from distribution center to tank truck, from tank truck to retail storage tank, and from retail storage tank to vehicle) some opportunity arises for small particles of dirt and debris, as well as other contaminants, to enter the tank with the fuel.

Moreover, it is well known that partially filled tanks of any sort or capacity are subject to internal condensation, wherein water vapor suspended in the air volume within the tank condenses onto the inner walls of the tank and runs down the walls. As water is heavier than fuel and will not dissolve in most fuels, such condensate will form a pocket or puddle at the lowest point(s) in the tank, below any fuel in the tank. While most pumping systems endeavor to avoid ingesting such condensate or other foreign matter, the possibility exists any time such foreign matter enters a fuel tank. The pumping of debris or water into a fuel tank is consequently and unfortunately an all too common occurrence.

While carbureted engines are generally somewhat more forgiving of such foreign matter mixed with the fuel, fuel injected systems generally include relatively small diameter injection nozzles in order to break up the fuel charge into smaller droplets more readily and thus to provide more efficient combustion. This is particularly true of diesel truck engines, which are relatively susceptible to injector and other engine damage, particularly due to water ingestion.

Means for the removal of such water and foreign matter have generally consisted of relatively costly filters installed between the tank and the injectors on the truck. Such filters are relatively inefficient, and it may take quite a number of filters (e.g. up to 25 filters) to filter one gallon of water from 100 gallons of fuel. It would be more desirable to remove the contamination from the tank directly, rather than attempting to filter it out as it passes through the fuel system.

While siphons and other extraction systems and devices have been developed, they have been only partially effective at best due to the difficulty in seeing the pocket of water or other contamination in the bottom of a darkened fuel tank. The interface between water and fuel may be readily observed if there is sufficient light, but of course lights are not provided in fuel tanks.

The need arises for an illuminated siphon device for the withdrawal of contamination from fuel tanks, particularly the fuel tanks of diesel trucks. The device must provide a safe source of light within the tank, preferably aligned with the end of the siphon installed within the tank. The device should be relatively economical to purchase, allowing virtually anyone with a need for such a device to possess one. Finally, it should be relatively small, compact and light weight in order to be readily carried aboard the vehicle for which it is needed.

DESCRIPTION OF THE PRIOR ART

Various tank and other cleaning devices and siphons are known in the prior art. Those patents uncovered in the course of a search relating to the present invention, and as a result of the examination of the parent application to the present application, are discussed immediately below.

U.S. Pat. No. 1,863,203 issued to Bert C. Lewis on Jun. 14, 1932 discloses a Water Supply Device For Batteries. While the device includes an electric light, the light emission is immediately adjacent the handle and outlet end of the tube, rather than being remotely located at the suction or inlet end of the tube, as in the present invention.

U.S. Pat. No. 2,002,107 issued to Clyde E. Bourret on May 21, 1935 discloses an Illuminated Hose Nozzle wherein the light source radiates from a point immediately adjacent the handle, as in the Lewis patent discussed above. Again, the light is located at the outlet end of a supply nozzle, rather than at the inlet end of a suction or siphon tube, as in the present invention.

U.S. Pat. No. 2,005,251 issued to Straud K. Wood et al. on Jun. 18, 1935 discloses a Light For Gasoline Dispensing Nozzles which light source is disposed adjacent the outlet end of the nozzle and is physically separated from the battery by the length of the nozzle. Again, the light is located at the outlet end of the supply nozzle, rather than at the inlet end of a suction tube.

U.S. Pat. No. 2,260,325 issued to Ward Leathers on Oct. 28, 1941 discloses a Vacuum Cleaner including vibratory or beater bar means. While a wiring diagram and portion of the specification make note of a light, no location or purpose for the light is disclosed. It appears to be a pilot or annunciator light to provide notice that the beater bar system is in operation, rather than to provide illumination for operation of the vacuum cleaner in a darkened area. Moreover, the device is incapable of functioning as a liquid siphon tube, let alone with fuels, and the head portion is so large as to preclude insertion into any narrow or small opening, as provided by the present invention.

U.S. Pat. No. 2,637,062 issued to Otis B. Sutton et al. on May 5, 1953 discloses a Suction Nozzle With Removable Wand And illuminating Means. While the light is intended to provide illumination at the inlet end of the vacuum, the same limitations (not adaptable to use with fluids or fuels, relatively wide nozzle head) apply here as to the Leathers patent discussed above.

U.S. Pat. No. 3,341,880 issued to Einar T. Young on Sep. 19, 1967 discloses a Tank Cleaning Apparatus comprising a coiled hose upon a reel. The hose is inserted downward into the tank vent and through a specially formed guide. The apparatus requires a specially constructed or modified tank and makes no provision for the cleaning of vehicle tanks. Moreover, no illumination means is disclosed.

U.S. Pat. No. 4,291,839 issued to Dennis A. Brett on Sep. 29, 1981 discloses a Vehicle Rust-Inhibiting Spray Gun With Lighting Means. The device is a dispensing, rather than an intake, nozzle, and the light source is disposed somewhat away from the outlet nozzle, rather than immediately adjacent the nozzle for working in confined areas, as in the case of the present invention.

U.S. Pat. No. 4,797,206 issued to James P. Lynch on Jan. 10, 1989 discloses a Siphon Device For Cleaning Spas. A single tube is disclosed with a relatively stiff outer protective tube over a portion thereof. No illumination means is disclosed, and as the device is intended for use with water, no disclosure is made of any resistance to deterioration due to immersion in fuel. Moreover, no transparency of the components is disclosed in order that contaminates flowing therethrough may be observed.

U.S. Pat. No. 5,082,028 issued to Leonard Jean-Jacques on Jan. 21, 1992 discloses a Pool Cleaner Suction Pipe. Again, no disclosure is made of any illumination means or transparency, nor is any means providing resistance to deterioration from fuel immersion disclosed.

U.S. Pat. No. 5,152,026 issued to Philip F. Scarpine on Oct. 6, 1992 discloses a Cooling Tower Cleaning Device including a variety of inlet nozzles providing mechanical means for the removal of foreign matter which may have adhered to the inside of the tower, unlike the present invention. However, the patent fails to disclose any lighting means for the apparatus, even though it is intended to be used to withdraw water (not fuel) from an enclosed tank.

British Patent No. 961,828 to Harold Benn et al. published on Jun. 24, 1964 discloses a Cleaning Device For Water Tanks. A plurality of hoses including an air hose and surrounding containment bag are disclosed; the device operates by means of an electric air compressor, using an air lift principle. No illumination means, transparency or fuel resistance is disclosed.

Japanese Pat. No. 60-185,000 to Shigetomi Tanaka published on Sep. 20, 1985 discloses a Hose Pump For Suction And Discharge. While disclosure is made of a trifurcate assembly comprising an inlet tube, an outlet tube, and an offset squeeze bulb, no mention is made of any lighting means, as the apparent intended usage as shown in FIG. 4 is for the withdrawal of sediment from the bottom of an open pool or tank. Further, no apparent disclosure is made of the use of the device in withdrawing contamination from fuel tanks, and compatibility with fuels.

German Patent No. 1,248,896 to Ernst Jacobi published on Aug. 31, 1967 discloses a pneumatic Suction Nozzle for use in cleaning textile and spinning machinery and having a specific shape and advantages thereto. No additional apparatus is disclosed other than the nozzle nor is any illumination means or fuel resistance disclosed.

Finally, Netherlands Pat. No. 8102-763 to the Research Institut 'Sesto' B. V. published on Jan. 3, 1983 discloses Fuel Siphoning Equipment From (a) jerry Can. The siphon bulb is substantially displaced from the handle portion, thus requiring a length of flexible tube therebetween, and no lighting means is disclosed.

None of the above noted patents, taken either singly or in combination, are seen to disclose the specific arrangement of concepts disclosed by the present invention.

SUMMARY OF THE INVENTION

By the present invention, an improved siphon device is disclosed.

Accordingly, one of the objects of the present invention is to provide a siphon device for use in withdrawing water and other contaminates from vehicle fuel tanks.

Another of the objects of the invention is to provide a siphon device including means for illuminating an area within the tank which the siphon is being applied.

Yet another of the objects of the present invention is to provide a siphon device which illumination source is disposed outside the fuel tank when the device is in use, but which illumination is transmitted to a point adjacent the siphon inlet.

Still another of the objects of the present invention is to provide a siphon device providing a clear line of sight along one side of the inlet tube, with the illumination transmission means disposed to the opposite side of the inlet tube from the sight line.

A further object of the present invention is to provide a siphon device which is resistant to deterioration due to immersion or contact with various fuels.

An additional object of the present invention is to provide a siphon device which includes mechanical means for siphoning.

Another object of the present invention is to provide a siphon device in which the mechanical siphoning means comprises a hand operated pump.

Still another object of the present invention is to provide a siphon device which is compact, lightweight, and of economical construction.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
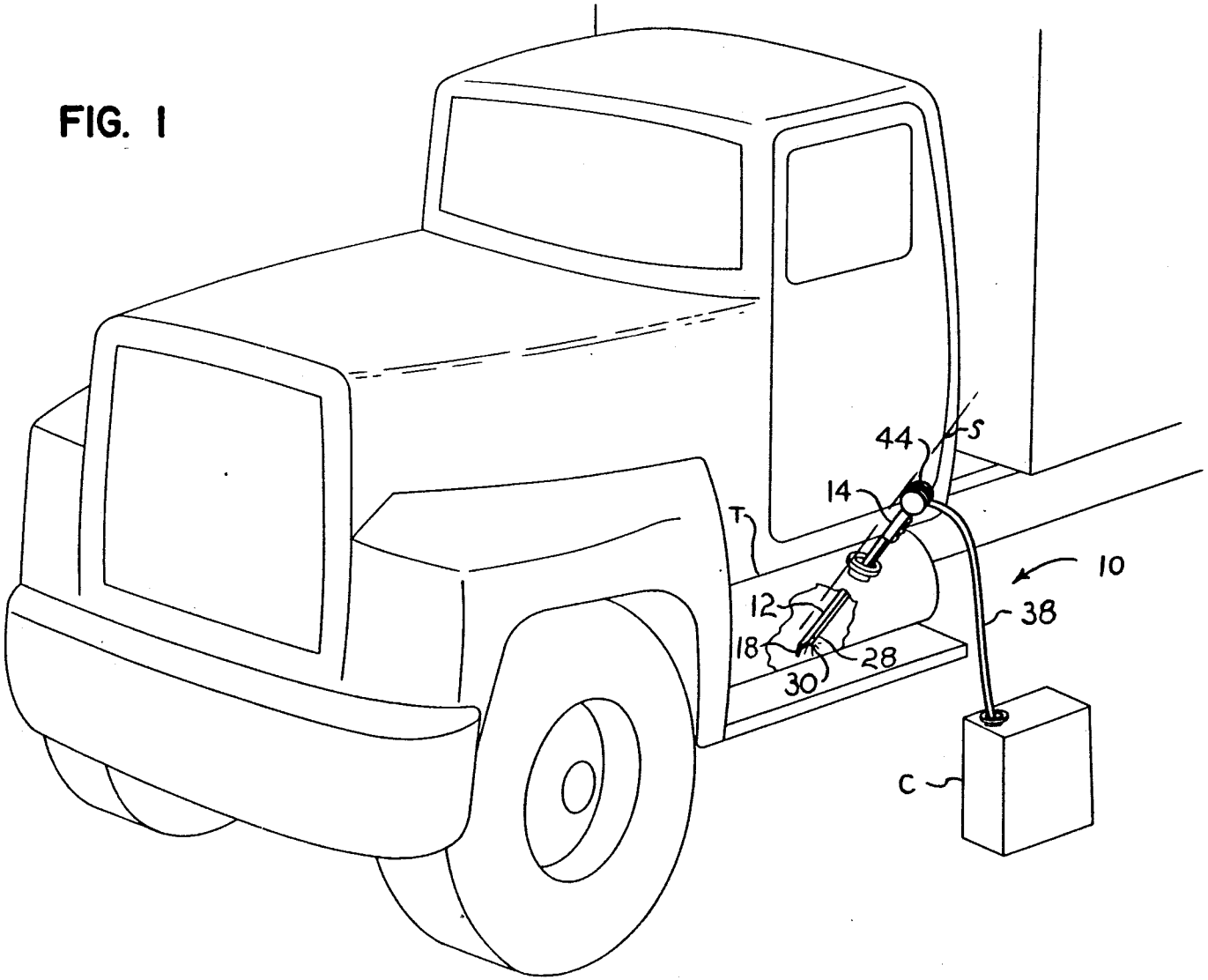
FIG. 1 is a perspective view of the present invention in use, showing the siphon of the present invention with its self contained illumination means inserted into a vehicle fuel tank for withdrawal of contamination therefrom.
Figure 2:
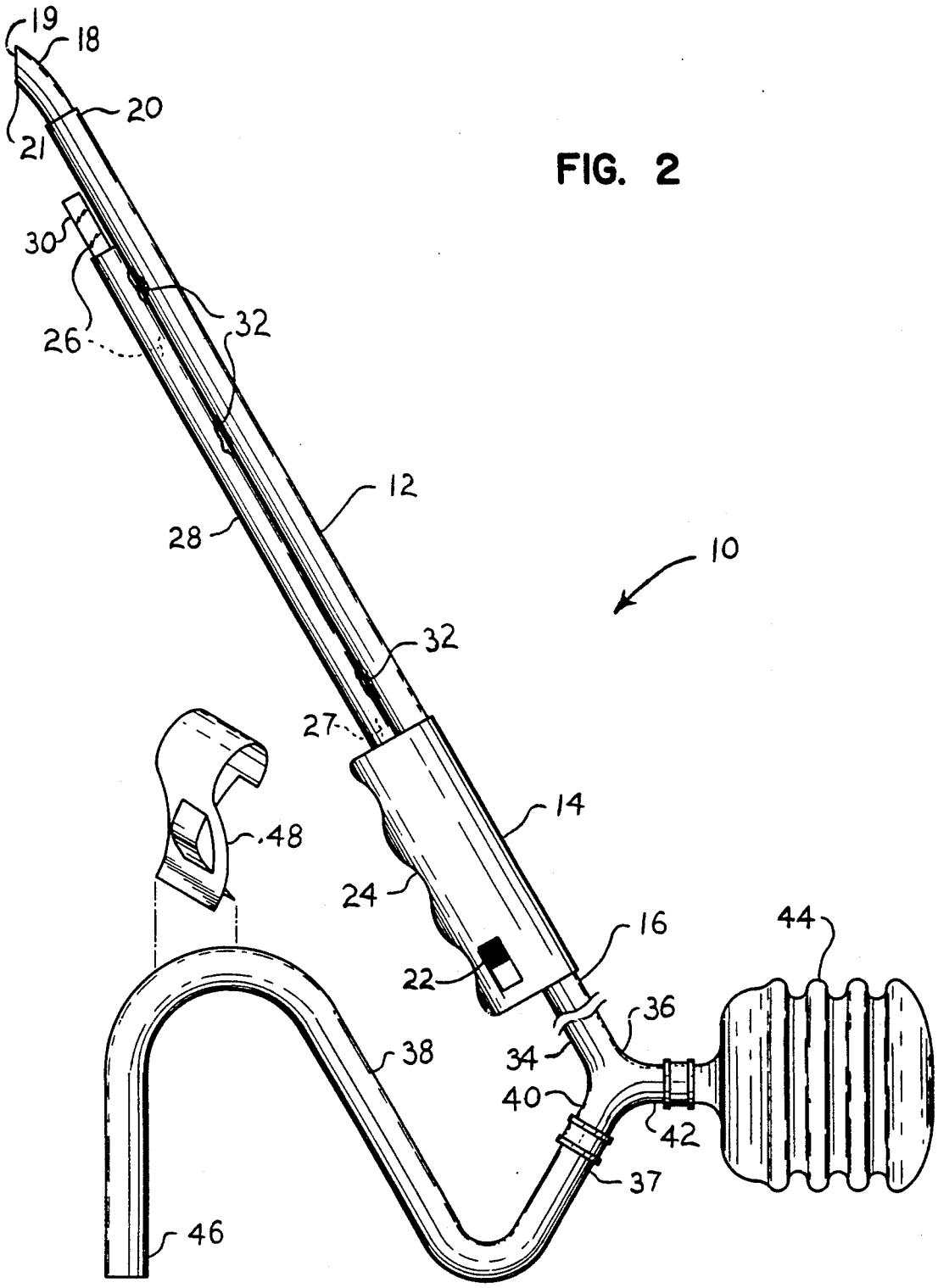
FIG. 2 is an enlarged perspective view of the illuminated siphon of the present invention, with the inlet tube and illumination means shown broken away and turned 90 degrees for ease of illustration.

Referring now particularly to FIG. 1 of the drawings, the present invention will be seen to relate to an illuminated siphon device 10 for use in withdrawing water condensate and other contaminates from a vehicle fuel tank T. FIG. 2 provides a more detailed view of siphon 10, more clearly showing its various components.

The primary component of siphon 10 is an elongate pipe 12, to which a light source 14 is secured near a first or upper end 16. Pipe 12 is preferably of a relatively stiff and inflexible clear or transparent material, such as a clear polycarbonate plastic, in order that water and other contaminates, as well as fuel, being drawn upward through pipe 12 may be seen by the user of siphon 10. It is also important that pipe 12, as well as other components of siphon 10, be relatively resistant to damage from contact with typical vehicle fuels, such as gasoline or diesel fuel.

The distal second end 20 of pipe 12 will be seen to have another section of hose 18 coaxially installed. This distal or inlet hose 18 is preferably also of a clear or transparent material, such as polyethylene plastic, and is preferably flexible in order to conform better to corners and internal seams within a tank T. The mouth or opening 19 of inlet hose 18 is preferably cut to preclude any close fit against the interior of a tank T, in order that it will not seal against an interior surface. The opening 19 of inlet hose 18 may be cut at an obtuse angle 21 as shown, or other shapes may be formed for opening 19. Inlet hose 18 is preferably of a smaller diameter than that of the siphon pipe 12, in order to accelerate the liquid flow through the smaller diameter inlet hose 18 in order to assist in drawing up small particles of solid debris in addition to water pockets in the tank T.

Light source 14 is secured near the first or upper end 16 of pipe 12, as noted above. Light source 14 preferably comprises a housing containing an electric light (e.g., incandescent bulb, although other types of light may be used) and battery or batteries providing power for the electric light. The circuit is actuated by a switch 22, which may be a slide switch as shown, or alternatively may comprise a toggle switch, momentary contact push button switch, etc. The housing may also provide handle means or a grip 24 in addition to being the light source 14 and housing therefor.

In order to transmit the light from the light source 14 at the upper end 16 to the opposite inlet end 20 of the pipe 12, a light transmission means comprising a light conductive conduit or path 26 is provided along one side of the inlet pipe 12. Light path 26 includes a first or upper end 27 cooperating with the light source 14, and is preferably a relatively rigid material, such as a clear Lucite (tm) plastic rod, in order to closely match the stiffness characteristics of the inlet pipe 12. However, other materials may be used, such as a fiber optic bundle secured to the side of the pipe 12 to provide a light source near the distal end 20 of pipe 12. In order to preclude the radiation of light from the sides of the light path 26, it is covered with an opaque coating or material 28 (black plastic tube or sleeve, etc. ). The extreme distal second end 30 is uncovered in order to provide light radiation adjacent the inlet nozzle 18 of the lighted siphon device 10.

Light path 26 (and of course its opaque coating or covering 28) may be adhesively secured to pipe 12 by means of an epoxy fillet 32 or other material which is relatively impervious to degradation from contact with typical fuels. Alternatively, mechanical attachment means may be used, such as screw type hose clamps or other means (wire, etc. ). The precise means of securing the light transmission path 26 along the length of pipe 12 is not critical, so long as that means is not susceptible to degradation due to contact with fuels of various sorts. It is also important that the light path 26 be secured generally parallel to pipe 12 in order to cause the primary direction of the projected light beam to be parallel to pipe 12 near its distal end 20, as is clearly shown in FIG. 2.

The upper or first end 16 of the siphon pipe 12 is connected to a first branch 34 of a trifurcate or "Y" fitting 36, with the first or upper end 37 of an outlet hose 38 connected to a second branch 40 of the fitting 36. The outlet hose 38 is preferably formed of a clear and flexible length of tubing, such as a polyethylene plastic, in the manner of inlet hose 22, in order that the user of siphon 10 may readily see any water or other contaminates, fuel, etc. which are drawn through siphon 10.

The third branch 42 of the trifurcate fitting 36 provides for the attachment of a pump means 44. Pump means 44 may comprise a hand operated one way valve, operated by squeezing the bulb, to draw contaminates and liquids upward through pipe 12. Alternative means may be used, such as a motorized pump, operating from an electrical power source such as the vehicle electrical system. Any form of suction may be used to draw contaminates and liquids up the tube, and once the liquid flows back down through the various tubes and pipe of siphon 10 to below the level of the opening 19 of inlet hose 18 in tank T, an automatic siphoning action will continue, as is well known. The second or outlet end 46 of the outlet hose 38 may be inserted into a container or can C in order to capture the outflow, as shown in FIG. 1.

In order to allow the user to have a clearer line of sight along the inlet pipe or tube 12, the trifurcate fitting 36 will be seen to be turned 90 degrees to the orientation generally shown in FIG. 2. The actual siphon 10 would have the inlet tube 12, light source 14 and light transmission means 26, as shown from the break line in FIG. 2, axially rotated 90 degrees to place the side of the pipe 12 opposite the light transmission means 26 away from alignment with the plane of the "Y" connection 36 and pump bulb 44. FIG. 1 provides a more accurate rendition of this arrangement, showing the pump bulb 44 offset to the near side of the trifurcate fitting, and providing a clear line of sight S along the inlet pipe 12 on the side of the pipe 12 opposite the light transmission means 26. Thus, the apparatus may be more precisely placed as desired by means of the sight line S provided.

Siphon 10 is used by first inserting the distal flexible inlet hose 18 and the lower or inlet end 20 of the pipe 12 into a tank T to a depth as required, and the distal or outlet end 46 of outlet hose 38 into a container C, positioned below the level of the bottom of the tank T. The light source 14 may then be activated by means of switch 22. The relatively stiff and inflexible pipe may then be maneuvered within the tank T, searching out any pockets of water or other sediment and contaminates within tank T by means of light source 14 and the light emission from the distal or emission end 30 of the light transmission means 26; such water or contaminates will be readily visible within the darkened interior of tank T, due to the light provided by light source 14 and the light transmission means 26. When a pocket of water or contaminates is seen, the mouth or opening 19 of inlet hose 18 will be automatically aligned with the contaminate pocket due to the general alignment of the light transmission means 26 and light emission end 30 with inlet pipe 12. The angled cut 21 of inlet hose opening 19 will provide for flow into inlet hose 18, particularly in the case of saddle tanks and other tanks with rounded bottoms; the generally flat cut 21 of inlet hose opening 19 will provide some slight opening along the curved interior bottom of a saddle tank T as shown in FIG. 1. Moreover, the relatively smaller diameter of the inlet nozzle or hose 18 will cause an accelerated flow therethrough, due to a Venturi effect, which accelerated flow will tend to pick up relatively small solid particles of material in addition to water contamination.

Once the inlet hose 18 has been maneuvered within a tank T as desired, siphon action is started by releasing any restriction clamps such as clamp 48 which may be installed on the siphon 10, and actuating pump means or bulb 44. As noted above, once flow has commenced through the tubes and pipe of siphon 10 to a level below the level of inlet hose opening 19, automatic siphoning action will continue and any pumping action may be discontinued. Water and contaminates, as well as any fuel withdrawn, will collect in container C for later discard or filtering. If the tank T has more than one low spot where contaminates have collected, siphoning action may be temporarily halted by installing a restriction clamp 48 to outlet hose 38 (or pinching the outlet hose 38) to reposition the light source 14 and inlet pipe 12 as desired, and releasing the restriction clamp 48 to continue the siphoning operation when the inlet pipe 12 is repositioned. The operation may of course be repeated as long or as many times as necessary in order to remove contaminates from the tank T.

When the siphoning operation has been completed, siphon 10 may be drained of residual fuel and stored as desired, e.g. in the cab or other area of the truck or vehicle for future use as needed. Any fuel withdrawn from the tank T and collected within the container C will float atop any contaminates, and so may be poured back into the tank T if desired; it may be desirable to filter the contents of container C before returning any fuel to the tank T, but this is easily and economically done by means of pouring the fuel through a chamois or other filtering sheet or material.

Accordingly, the present invention provides a relatively economical and efficient means of removing water and other contaminates from a vehicle fuel tank T. The savings in material, such as in line fuel filters, is significant, as is the labor saved by not having to remove and replace a number of in line filters to accomplish such contaminate removal. The siphon of the present invention provides a relatively quick and easy method of contaminate removal, due to the integral light source as well as other features. The inexpensive construction and provision for reuse of the siphon of the present invention provide a device which is a significant improvement in the field.

It is to be understood that the present invention is not limited to the sole embodiment described above, but encompasses any and all embodiments within the scope of the following claims.

I claim:

1. An illuminated siphon for use in the removal of water, sediment and other contaminates from fuel tanks, said siphon comprising:

an elongate, rigid liquid transfer pipe having an outer surface and an inner surface and an upper first end and an opposite second end, with a light source secured to said second outer surface of said liquid transfer pipe near said first end of said rigid liquid transfer pipe;

elongate light transmission means secured axially parallel to said rigid liquid transfer pipe, extending along said outer surface to strengthen said liquid transfer pipe, and having a first end cooperating with said light source and an opposite second end disposed adjacent said second end of said rigid liquid transfer pipe with said second end of said light transmission means providing for radiation of transmitted light within said fuel tank to facilitate removal of water, sediment, and other contaminates therefrom;

an elongate, flexible liquid transfer outlet hose having a first end and an opposite distal second outlet end;

a fitting providing connection means for said liquid transfer pipe and said flexible liquid transfer outlet hose with one another;

a distal inlet hose secured to said second end of said rigid liquid transfer pipe;

said distal inlet hose has an inlet opening having an obtuse angle relative to said distal inlet hose, whereby;

said rigid liquid transfer pipe second end is inserted within a fuel tank and said light source is activated, said rigid liquid transfer pipe is maneuvered to observe any contaminate collections in the fuel tank by means of light emitted by said light transmission means second end, and a siphoning action is initiated to withdraw the observed contaminates from the fuel tank by means of said rigid liquid transfer pipe and said flexible liquid transfer outlet hose.

2. The siphon of claim 1 including:

pump means connected to said fitting and cooperating with said rigid liquid transfer pipe and said flexible liquid transfer outlet hose.

3. The siphon of claim 2 wherein:

said pump means comprises a hand operated siphon pump.

4. The siphon of claim 2 wherein:

said fitting comprises a trifurcated connector having a first branch cooperating with said rigid liquid transfer pipe, a second branch cooperating with said flexible liquid transfer hose, and a third branch cooperating with said pump means.

5. The siphon of claim 4 wherein:

said first, second and third branches of said trifurcated connector together define a first plane, and said rigid liquid transfer pipe and said elongate light transmission means axially parallel thereto together define a second plane, with said first and second planes being non-coplanar, whereby;

a clear line of sight along said rigid liquid transfer pipe opposite said light transmission means is provided.

6. The siphon of claim 1 wherein:

said rigid liquid transfer pipe and said flexible liquid transfer hose are formed of transparent material, whereby;

contaminates and fuel flowing within said rigid liquid transfer pipe and said flexible liquid transfer hose are observable.

7. The siphon of claim 1 wherein:

at least said rigid liquid transfer pipe, said trifurcated connector, and said flexible liquid transfer hose are formed of material resistant to degradation by fuel.

8. The siphon of claim 1 wherein:

said distal inlet hose is formed of transparent material, whereby;

contaminates and fuel flowing within said distal inlet hose are observable.

9. The siphon of claim 1 wherein:

said distal inlet hose is formed of material resistant to degradation by fuel.

10. The siphon of claim 1 wherein:

said elongated light transmission means comprises a transparent plastic rod.

11. The siphon of claim 1 wherein:

said light transmission means is adhesively secured to said rigid liquid transfer pipe.

12. The siphon of claim 1 including:

switch means providing for the activation and deactivation of said light source.

13. The siphon of claim 1 wherein:

said light source includes a housing therearound.

14. The siphon of claim 18 wherein:

said housing is configured to provide handle means for said siphon.

15. An illuminated siphon for use in the removal of water, sediment and other contaminates from fuel tanks, said siphon comprising:

an elongate, rigid liquid transfer pipe having an outer surface and an inner surface and an upper first end and an opposite second end, with alight source secured to said second outer surface of said liquid transfer pipe near said first end of said rigid liquid transfer pipe;

elongate light transmission means secured axially parallel to said rigid liquid transfer pipe, extending along said outer surface to strengthen said liquid transfer pipe, and having a first end cooperating with said light source and an opposite second end disposed adjacent said second end of said rigid liquid transfer pipe with said second end of said light transmission means providing for radiation of transmitted light within said fuel tank to facilitate removal of water, sediment, and other contaminates therefrom;

an elongate, flexible liquid transfer outlet hose having a first end and an opposite distal second outlet end;

a fitting providing connection means for said liquid transfer pipe and said flexible liquid transfer outlet hose with one another;

a distal inlet hose secured to said second end of said rigid liquid transfer pipe;

said distal inlet hose has a diameter smaller than that of said rigid liquid transfer pipe resulting in an acceleration of liquid flow through said distal inlet hose when said siphon is operated, whereby;

said rigid liquid transfer pipe second end is inserted within a fuel tank and said light source is activated, said rigid liquid transfer pipe is maneuvered to observe any contaminate collections in the fuel tank by means of light emitted by said light transmission means second end, and a siphoning action is initiated to withdraw the observed contaminates from the fuel tank by means of said rigid liquid transfer pipe and said flexible liquid transfer outlet hose.

16. An illuminated siphon for use in the removal of water, sediment and other contaminates from fuel tanks, said siphon comprising:

an elongate, rigid liquid transfer pipe having an outer surface and an inner surface and an upper first end and an opposite second end, with a light source secured to said second outer surface of said liquid transfer pipe near said first end of said rigid liquid transfer pipe;

elongate light transmission means including an opaque coating thereon and an uncoated distal end portion secured axially parallel to said rigid liquid transfer pipe, extending along said outer surface of strengthen said liquid transfer pipe, and having a first end cooperating with said light source and an opposite second end disposed adjacent said second end of said rigid liquid transfer pipe with said second end of said light transmission means providing for radiation of transmitted light within said fuel tank to facilitate removal of water, sediment, and other contaminates therefrom;

an elongate, flexible liquid transfer outlet hose having a first end and an opposite distal second outlet end;

a fitting providing connection means for said liquid transfer pipe and said flexible liquid transfer outlet hose with one another, whereby;

said rigid liquid transfer pipe second end is inserted within a fuel tank and said light source is activated, said rigid liquid transfer pipe is maneuvered to observe any contaminate collections in the fuel tank by means of light emitted by said light transmission means second end, and a siphoning action is initiated to withdraw the observed contaminates from the fuel tank by means of said rigid liquid transfer pipe and said flexible liquid transfer outlet hose.

17. The siphon of claim 16 wherein:

said opaque coating comprises a plastic sleeve.

* * * * *